US012807378B2

(12) United States Patent
Patterson et al.

(10) Patent No.: US 12,807,378 B2
(45) Date of Patent: Nov. 24, 2026

(54) DISPENSING PLUGS FOR FLEXIBLE FLUID CONTAINERS

(71) Applicant: Alcon Inc., Fribourg (CH)

(72) Inventors: Brian C. Patterson, Burleson, TX (US); Allison Renee Campolo, Euless, TX (US); Monica Jane Crary, Fort Worth, TX (US); Reed Allen Pifer, Willow Park, TX (US); Stephen Paul Shannon, Arlington, TX (US)

(73) Assignee: Alcon Inc., Fribourg (CH)

( * ) Notice: Subject to any disclaimer, the term of this patent is extended or adjusted under 35 U.S.C. 154(b) by 156 days.

(21) Appl. No.: 18/889,031

(22) Filed: Sep. 18, 2024

(65) Prior Publication Data

US 2025/0100760 A1 Mar. 27, 2025

Related U.S. Application Data

(60) Provisional application No. 63/585,273, filed on Sep. 26, 2023.

(51) Int. Cl.
*B65D 47/20* (2006.01)
*B65D 83/00* (2006.01)

(52) U.S. Cl.
CPC ..... *B65D 47/2075* (2013.01); *B65D 83/0094* (2013.01)

(58) Field of Classification Search
CPC ..... B65D 47/2075; B65D 83/0094; B65D 47/18; A61F 9/0008
See application file for complete search history.

(56) References Cited

U.S. PATENT DOCUMENTS

| | | | | | |
|---|---|---|---|---|---|
| 5,074,440 | A | | 12/1991 | Clements | |
| 5,169,031 | A | * | 12/1992 | Miller | F17C 9/00 222/481.5 |
| 5,405,050 | A | * | 4/1995 | Walsh | B67D 3/043 222/1 |
| 5,685,459 | A | * | 11/1997 | Wardle | B65B 31/006 222/518 |
| 6,003,734 | A | * | 12/1999 | Oh | B67D 3/02 141/357 |
| 10,358,261 | B2 | * | 7/2019 | Sugita | B65D 35/10 |
| 10,994,919 | B2 | | 5/2021 | Hochberg | |
| 11,618,664 | B2 | * | 4/2023 | Castonguay | B67D 1/0878 222/251 |
| 2010/0072301 | A1 | | 3/2010 | Cater | |
| 2012/0067926 | A1 | | 3/2012 | Ishikawa | |
| 2017/0240416 | A1 | * | 8/2017 | Gray | B67D 7/42 |
| 2025/0100760 | A1 | * | 3/2025 | Patterson | A61F 9/0008 |

FOREIGN PATENT DOCUMENTS

| | | | | | |
|---|---|---|---|---|---|
| CN | 218173199 | U | | 12/2022 | |
| CN | 115607442 | A | | 1/2023 | |
| GB | 2133502 | A | * | 7/1984 | F17C 13/04 |
| JP | H11149937 | A | * | 6/1999 | |

* cited by examiner

*Primary Examiner* — Bob Zadeh
(74) *Attorney, Agent, or Firm* — Nicholas Smith

(57) ABSTRACT

In certain embodiments, a dispensing plug includes a fluid path having an inlet and an outlet. The dispensing plug also includes a valve adjustably disposed relative to the fluid path. The valve includes a first valve portion positioned in the fluid path between the inlet and the outlet. The valve also includes a second valve portion oriented to cause a first force to be exerted on the first valve portion. The first force biases the first valve portion toward closure of the fluid path.

17 Claims, 7 Drawing Sheets

DISPENSING PLUGS FOR FLEXIBLE FLUID CONTAINERS

BACKGROUND

Many pathologies of the eye are treated by direct application of fluids to the eye, such as liquid eye drops. For example, conjunctivitis is treated by directly applying eye drops containing antibiotics. Dry eyes and glaucoma are also treated using eye drops. In general, eye drops and other treatment fluids can be used as lubricants for relieving discomfort and dryness of the eyes, as well as delivery vehicles for therapeutic substances.

Eye drops, as well as other treatment fluids, are typically stored in flexible containers. To apply a treatment fluid to a patient's eye, the flexible container is manually compressed by a user to dispense the treatment fluid through a nozzle or other opening in the flexible container. However, there is a risk of microbial ingress to the container.

SUMMARY

In certain embodiments, one general aspect includes a dispensing plug. The dispensing plug includes a fluid path having an inlet and an outlet. The dispensing plug also includes a valve adjustably disposed relative to the fluid path. The adjustable valve includes a first valve portion positioned in the fluid path between the inlet and the outlet. The adjustable valve also includes a second valve portion oriented to cause a first force to be exerted on the first valve portion. The first force biases the first valve portion toward closure of the fluid path.

In certain embodiments, another general aspect includes a system for dispensing fluids. The system includes a flexible container and a dispensing plug placed within an opening of the flexible container. The dispensing plug includes a fluid path having an inlet and an outlet. The dispensing plug also includes a valve adjustably disposed relative to the fluid path. The valve includes a first valve portion positioned in the fluid path between the inlet and the outlet. The valve also includes a second valve portion oriented to cause a first force to be exerted on the first valve portion. The first force biases the first valve portion toward closure of the fluid path.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure provide an apparatus for dispensing fluids (including, without limitation, gels, emulsions, suspensions, and the like) from flexible containers, while enabling improved prevention of microbial ingress into the containers. Examples of flexible containers include, without limitation, eye drop dispensers, droptainers, drop bottles, squeeze bottles, dropping bottles, squeeze tubes, and the like. To actuate the dispensing of fluids contained within a flexible container, portions of a body of the flexible container may be compressed or squeezed by a user. This manual compression increases the pressure within the flexible container and/or compresses the fluids therein, thereby causing the fluids to be expelled through an opening, or outlet, of the flexible container, such as a nozzle.

In certain embodiments, a dispensing plug for a flexible container can include an adjustable valve disposed relative to a fluid path therein. The adjustable valve can include, for example, two valve portions that are oriented relative to each other to cause a force, or spring-like action, to be exerted on one of the two valve portions. The force can be created, for example, by a spring, by two magnets configured to attract each other, by two magnets configured to repel each other, or the like. In various embodiments, the force biases the valve portion on which it is exerted toward closure of the fluid path, for example, to seal the fluid path and thereby prevent microbial ingress into the flexible container. In various embodiments, when fluid pressure caused, for example, by manual compression of the flexible container, exerts an opposing force on the biased valve portion that overcomes the biasing force, the fluid path at least partially opens to dispense fluid through an opening, or outlet, therein. Examples will be described relative to the Drawings.

Figure 1:
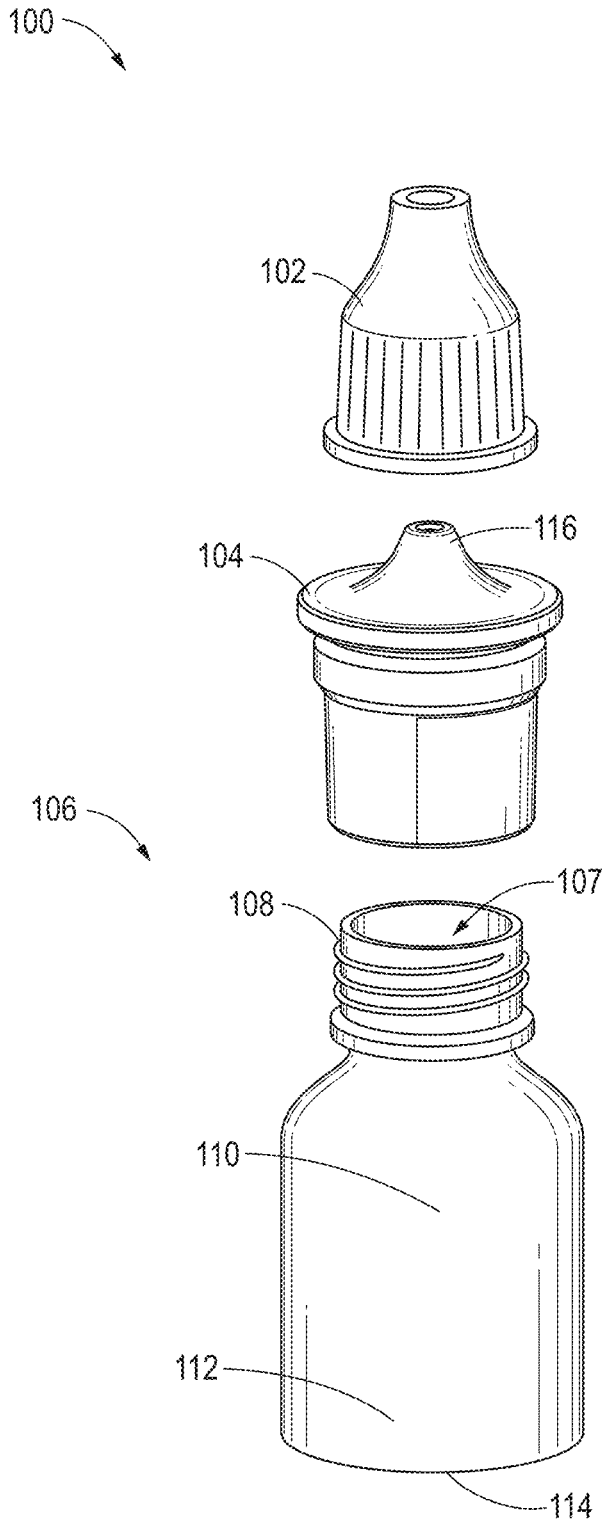
FIG. 1 is an exploded view of a system that may be utilized for dispensing fluids, according to certain embodiments of the present disclosure.

FIG. 1 is an exploded view of a system 100 that may be utilized for dispensing fluids. The system 100 includes a cap or nozzle 102, a dispensing plug 104, and a flexible container 106. In general, the dispensing plug 104 is placed within an opening 107 of the flexible container 106 and seals the opening 107 upon insertion therein. The dispensing plug 104 has a tip 116 and can be made, for example, wholly or partially of silicone or another polymer. The cap or nozzle 102 may be placed over the dispensing plug 104 and attached or fastened, for example, to the dispensing end 108 of the flexible container 106.

The flexible container 106 may be, for example, a bottle or droptainer. In the description herein, "proximal" with reference to the flexible container 106 shall be understood as the end of the flexible container comprising a base opposite of the dispensing end of the flexible container. "Distal" with reference to the flexible container shall be understood as the end of the flexible containers from which fluid contained in the flexible containers are dispensed.

In the illustrated embodiment, the flexible container 106 includes a body 110 having a tubular or cylindrical shape extending between an opening 107 at a dispensing end 108 and a proximal end 112 having an annular base 114. It should be appreciated that the shape shown relative to the body 110 is merely illustrative. In various embodiments, the body 110 can have any suitable geometry, shape, and/or size including, for example, tapered shapes, ovaloid shapes, and/or the like.

In the illustrated embodiment, fluid from the flexible container 106 can be transmitted from the opening 107 at the dispensing end 108, into the dispensing plug 104, by applying compression force against the outer surface of the body 110 of the flexible container 106, which may then increase the fluid pressure within the flexible container 106, to force fluids out the tip 116.

Figure 2A:
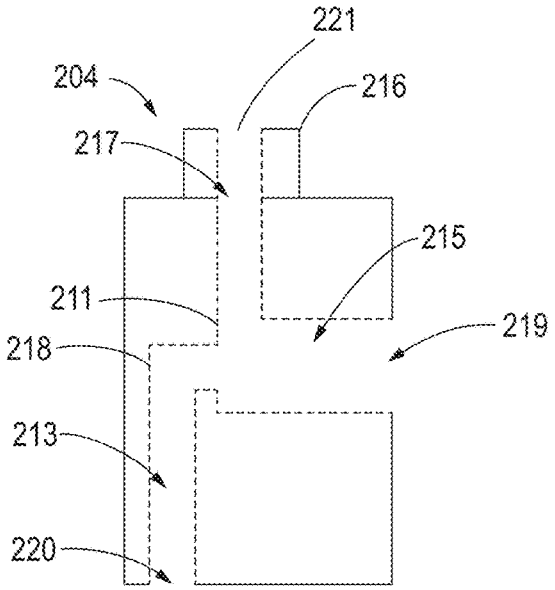
FIG. 2A is a cross-sectional view of an example dispensing plug body, according to certain embodiments of the present disclosure.

FIG. 2A is a cross-sectional view of a dispensing plug body 204. The dispensing plug body 204 may correspond, for example, to a body of the dispensing plug 104 of FIG. 1. The dispensing plug body 204 has a tip 216 similar to the tip 116 of FIG. 1. The dispensing plug body 204 may be made wholly or partially of silicone or another polymer and can include a fluid path 218 formed therein, where the fluid path 218 flows from an inlet 220 to an outlet 221 at the tip 216. The inlet 220 can correspond to an ingress point of fluids into the dispensing plug body 204 as generally described relative to the dispensing plug 104 of FIG. 1. The outlet 221 can correspond to an egress point of fluids out the tip 216.

In more detail, the fluid path 218 can include an inlet section 213, a valve-insertion section 215, and an outlet section 217. The inlet section 213 and the outlet section 217 include the inlet 220 and the outlet 221, respectively. The valve-insertion section 215 includes an inlet-side edge 211 and an opening 219. In the illustrated embodiment, the valve-insertion section 215 has a wider profile than either the inlet section 213 or the outlet section 217. In various embodiments, the wider profile of the valve-insertion section 215 accommodates opening and closing functionality of an adjustable valve, as will be described in greater detail relative to FIG. 2B.

Figure 2B:
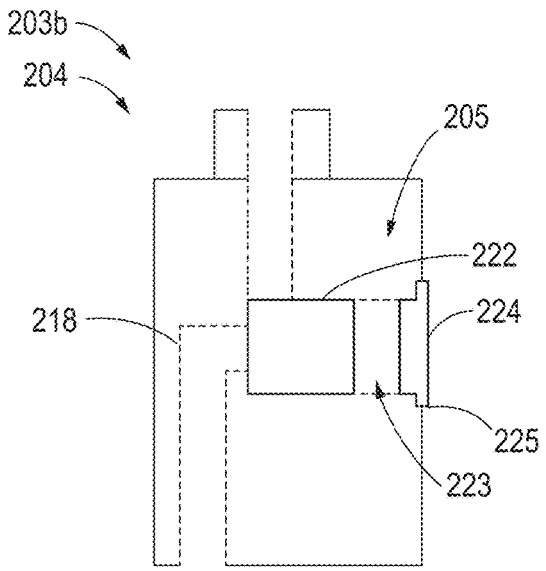
FIG. 2B is a cross-sectional view of an example dispensing plug utilizing the example dispensing plug body of FIG. 2A, according to certain embodiments of the present disclosure.

FIG. 2B is a cross-sectional view of a dispensing plug 203B utilizing the dispensing plug body 204 of FIG. 2A. The dispensing plug 203B includes the dispensing plug body 204 and an adjustable valve 205. The adjustable valve 205 is installed in the valve-insertion section 215 of the fluid path 218. In the illustrated embodiment, the adjustable valve 205 includes a valve portion 222 and a valve portion 224. The valve portion 222 and the valve portion 224 are positioned relative to the fluid path 218 such that a space 223 in the fluid path 218 separates the two valve portions.

With reference to the adjustable valve 205, in the illustrated embodiment, the valve portion 222 is positioned in the fluid path 218 between the inlet 220 and the outlet 221. With reference to FIGS. 2A-B collectively, the valve portion 224 is inserted in the opening 219 such that a lip 225 thereof secures the valve portion 224 to the dispensing plug body 204. The valve portion 224 is oriented relative to the fluid path 218 to cause a force to be exerted on the valve portion 222. For descriptive purposes, this force may be referred to herein as a biasing force. In certain embodiments, the biasing force may be a constant or continuing force that enables spring-like action in response to opposite or opposing force, as described in greater detail below. The biasing force may be supplied, for example, via magnetics, a spring, and/or the like. Examples of the biasing force will be described in greater detail relative to FIGS. 2C-D and 3A-B.

Still with reference to the adjustable valve 205, in certain embodiments, the biasing force biases the valve portion 222 toward closure of the fluid path 218. For example, with reference to FIGS. 2A-B collectively, the biasing force can cause the valve portion 222 to engage the inlet-side edge 211 of the valve-insertion section 215 and seal the fluid path 218 between the inlet 220 and the outlet 221. In certain embodiments, a narrower profile of the inlet section 213 halts further movement of the valve portion 222 in response to the biasing force, thus facilitating the seal. Specifically, the seal can block passage of fluids from the inlet section 213 to the outlet section 217.

Still with reference to the adjustable valve 205, in certain embodiments, the biasing force causes the valve portion 222 to seal the fluid path 218 between the inlet 220 and the outlet 221 as described above unless, or until, the biasing force is overcome by an opposing force such as, for example, fluid pressure on an inlet side of the valve portion 222 (i.e., from the inlet section 213). The fluid pressure can be caused by compression force against the outer surface of a body of a flexible container, such as the body 110 of the flexible container 106 of FIG. 1. In various embodiments, when the opposing force overcomes the biasing force, the valve portion 222 moves into the space 223 and at least partially opens the fluid path 218, thereby allowing fluids to flow from the inlet section 213 to the outlet section 217 and be dispensed out the tip 216 in proportion to an amount by which the opposing force exceeds the biasing force. In certain embodiments, when the opposing force no longer overcomes the biasing force, for example, as a result of a decrease in, or cessation of, the compression force, the biasing force, by virtue of its continuous or constant nature, immediately causes the valve portion 222 to again seal the fluid path 218 between the inlet 220 and the outlet 221 as described previously. In this way, the adjustable valve 205 can seal the fluid path 218 in the fashion described above whenever fluids are not being dispensed, thereby preventing microbial ingress, for example, from the outlet section 217 to the inlet section 213. Accordingly, in various embodiments, microbial ingress, for example, to a container such as the flexible container 106 of FIG. 1, can likewise be prevented.

Figure 2C:
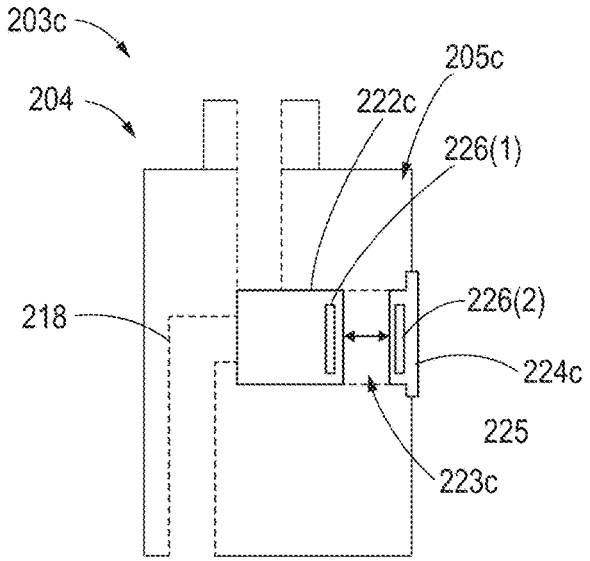
FIG. 2C is a cross-sectional view of another example dispensing plug utilizing the dispensing plug body of FIG. 2A, according to certain embodiments of the present disclosure.

FIG. 2C is a cross-sectional view of a dispensing plug 203C utilizing the dispensing plug body 204 of FIG. 2A. The dispensing plug 203C includes the dispensing plug body 204 and an adjustable valve 205C. In the illustrated embodiment, the adjustable valve 205C includes a valve portion 222C and a valve portion 224C that are positioned as generally described relative to the adjustable valve 205 of FIG. 2B, with a space 223C separating the two valve portions. In the illustrated embodiment, the valve portion 222C has a magnet 226(1) embedded therein and the valve portion 224C has a magnet 226(2) embedded therein.

In general, the adjustable valve 205C operates as described relative to the adjustable valve 205 of FIG. 2B, with the valve portion 224C being oriented relative to the fluid path 218 to cause a biasing force to be exerted on the valve portion 222C. In the example of FIG. 2C, the biasing force is created by a magnetic force between the magnet 226(1) and the magnet 226(2). More particularly, the magnet 226(1) and the magnet 226(2) have like poles and are thus configured to repel each other, such that the biasing force is a repelling force between the two magnets. In various embodiments, the magnet 226(1) and 226(2) may be of the same or different size, shape, and/or strength.

Figure 2D:
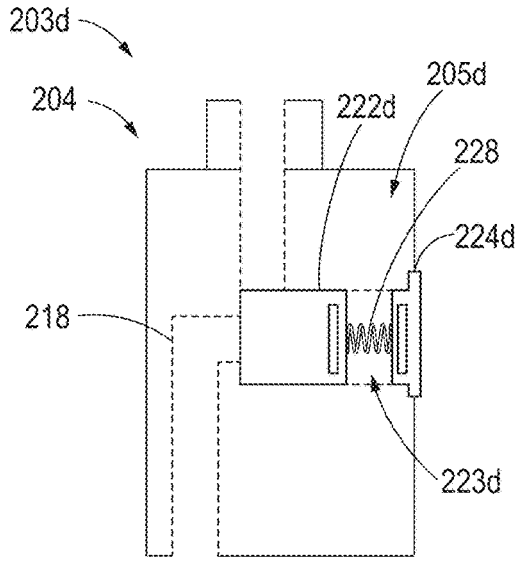
FIG. 2D is a cross-sectional view of another example dispensing plug utilizing the dispensing plug body of FIG. 2A, according to certain embodiments of the present disclosure.

FIG. 2D is a cross-sectional view of a dispensing plug 203D utilizing the dispensing plug body 204 of FIG. 2A. The dispensing plug 203C includes the dispensing plug body 204 and an adjustable valve 205D. In the illustrated embodiment, the adjustable valve 205D includes a valve portion 222D and a valve portion 224D that are positioned as generally described relative to the adjustable valve 205 of FIG. 2B, with a space 223D separating the two valve portions. In the illustrated embodiment, the valve portion 224D has a spring 228 extending therefrom into the space 223D and contacting the valve portion 222D.

In general, the adjustable valve 205D operates as described relative to the adjustable valve 205 of FIG. 2B, with the valve portion 224D being oriented relative to the fluid path 218 to cause a biasing force to be exerted on the valve portion 222D. In the example of FIG. 2D, the biasing force is configurably supplied via compression of the spring 228. Although the spring 228 is described as being a part of the valve portion 224D, in various embodiments, the spring 228 may be part of the valve portion 222D or be separate from each of the valve portion 222D and the valve portion 224D.

Figure 3A:
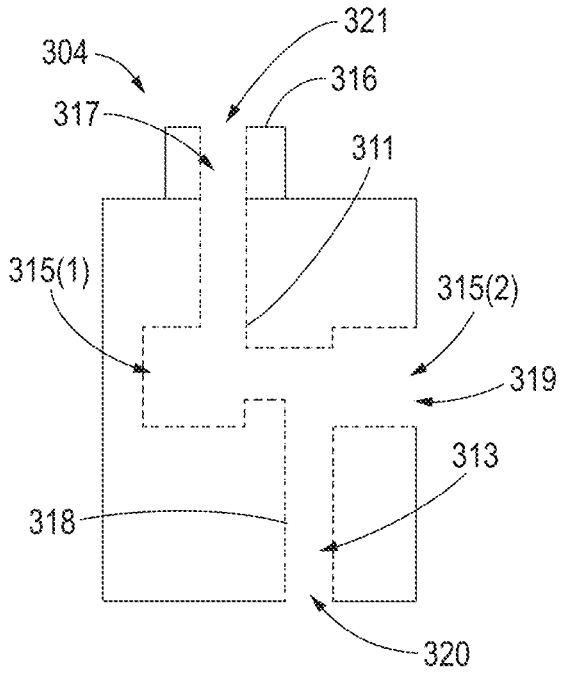
FIG. 3A is a cross-sectional view of an example dispensing plug body, according to certain embodiments of the present disclosure.

FIG. 3A is a cross-sectional view of a dispensing plug body 304. The dispensing plug body 304 may correspond, for example, to a body of the dispensing plug 104 of FIG. 1. The dispensing plug 304 has a tip 316 similar to the tip 116 of FIG. 1. The dispensing plug body 304 may be made wholly or partially of silicone or another polymer and can include a fluid path 318 formed therein, where the fluid path 318 flows from an inlet 320 to an outlet 321 at the tip 316. The inlet 320 can correspond to an ingress point of fluids into the dispensing plug body 304 as generally described relative to the dispensing plug 104 of FIG. 1, while the outlet 321 can correspond to an egress point of fluids out the tip 316.

In more detail, the fluid path 318 can include an inlet section 313, valve-insertion sections 315(1) and 315(2), and an outlet section 217. The inlet section 313 and the outlet section 317 include the inlet 320 and the outlet 321, respectively. The valve-insertion section 315(1) includes an inlet-side edge 311, while the valve-insertion section 315(2) includes an opening 319. In the illustrated embodiment, the valve-insertion sections 315(1) and 315(2) each have a wider profile than either the inlet section 313 or the outlet section 317. In various embodiments, the wider profiles of the valve-insertion sections 315(1) and 315(2) accommodate opening and closing functionality of an adjustable valve, as will be described in greater detail relative to FIG. 3B.

Figure 3B:
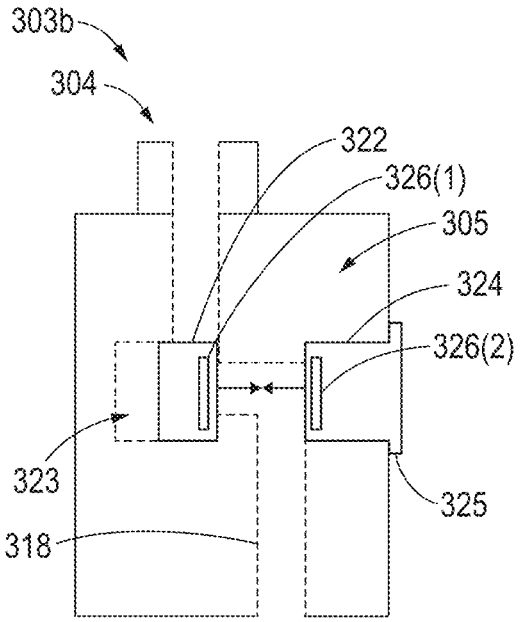
FIG. 3B is a cross-sectional view of an example dispensing plug utilizing the dispensing plug body of FIG. 3, according to certain embodiments of the present disclosure.

FIG. 3B is a cross-sectional view of a dispensing plug 303B utilizing the dispensing plug body 304 of FIG. 3. The dispensing plug 303B includes the dispensing plug body 304 and an adjustable valve 305 installed therein. In the illustrated embodiment, the adjustable valve 305 includes a valve portion 322 installed in the valve-insertion section 315(1) and a valve portion 324 installed in the valve-insertion section 315(2). The valve portion 322 and the valve portion 324 are positioned relative to the fluid path 318 such that a space 323 exists in the fluid path 318 on a side of the valve portion 322 opposite the valve portion 324. In the illustrated embodiment, the valve portion 322 has a magnet 326(1) embedded therein and the valve portion 324 has a magnet 326(2) embedded therein.

With reference to the adjustable valve 305, in the illustrated embodiment, the valve portion 322 is positioned in the fluid path 318 between the inlet 320 and the outlet 321. With reference to FIGS. 3A-B collectively, the valve portion 324 is inserted in the opening 319 such that a lip 325 thereof secures the valve portion to the dispensing plug body 304. The valve portion 324 is oriented relative to the fluid path 318 to cause a biasing force to be exerted on the valve portion 322, where the force biases the valve portion 322 toward closure of the fluid path 318. In the example of FIG. 3B, the biasing force is created by a magnetic force between the magnet 326(1) and the magnet 326(2). More particularly, the magnet 326(1) and the magnet 326(2) have opposite poles and are thus configured to attract each other, such that the biasing force is an attracting force between the two magnets. In various embodiments, the magnet 326(1) and 326(2) may be of the same or different size, shape, and/or strength.

Still with reference to the adjustable valve 305, in certain embodiments, the biasing force, in the form of the attracting force between the magnet 326(1) and the magnet 326(2), biases the valve portion 322 toward closure of the fluid path 218. For example, with reference to FIGS. 3A-B collectively, the biasing force can cause the valve portion 322 to engage the inlet-side edge 311 of the valve-insertion section 315(1) and seal the fluid path 318 between the inlet 320 and the outlet 321. In certain embodiments, a narrower profile of the inlet section 313 halts further movement of the valve portion 322 in response to the biasing force, thus facilitating the seal. Specifically, the seal can block passage of fluids from the inlet section 313 to the outlet section 317.

Still with reference to the adjustable valve 305, in certain embodiments, the biasing force causes the valve portion 322 to seal the fluid path 318 between the inlet 320 and the outlet 321 unless, or until, the biasing force is overcome by an opposing force such as, for example, fluid pressure on an inlet side of the valve portion 322 (i.e., from the inlet section 313). The fluid pressure can be caused by compression force against the outer surface of a body of a flexible container, such as the body 110 of the flexible container 106 of FIG. 1.

In various embodiments, when the opposing force overcomes the biasing force, the valve portion 322 moves into the space 323 and at least partially opens the fluid path 318, thereby allowing fluids to be dispensed out the tip 316 in proportion to an amount by which the opposing force exceeds the biasing force. In certain embodiments, when the opposing force no longer overcomes the biasing force, for example, as a result of a decrease in, or cessation of, the compression force, the biasing force, by virtue of its continuous or constant nature, immediately causes the valve portion 322 to again seal the fluid path 318 between the inlet 320 and the outlet 321 as described previously. In this way, the adjustable valve 305 can seal the fluid path 318 in the fashion described above whenever fluids are not being dispensed, thereby preventing microbial ingress, for example, from the outlet section 317 to the inlet section 313. Accordingly, in various embodiments, microbial ingress, for example, to a container such as the flexible container 106 of FIG. 1, can likewise be prevented.

Figure 4A:
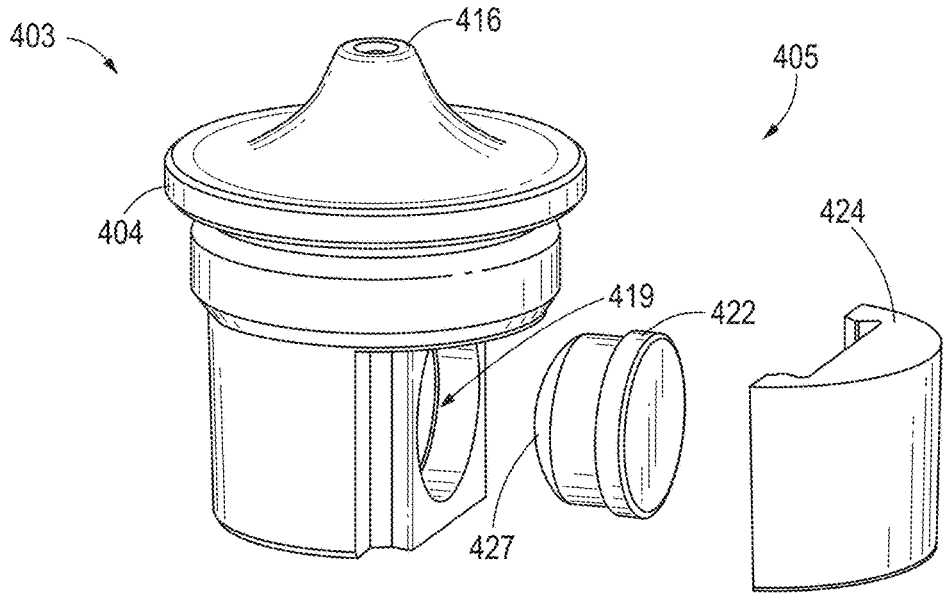
FIG. 4A is an exploded view of an example dispensing plug, according to certain embodiments of the present disclosure.

FIGS. 4A-E illustrate an example of a dispensing plug 403. FIG. 4A is an exploded view of the dispensing plug 403. The dispensing plug 403 includes a dispensing plug body 404 and an adjustable valve 405. In the illustrated embodiment, the adjustable valve 405 includes a valve portion 422 and a valve portion 424. In general, the dispensing plug 403 can operate as described relative to the dispensing plug 203C of FIG. 2C.

Figure 4B:
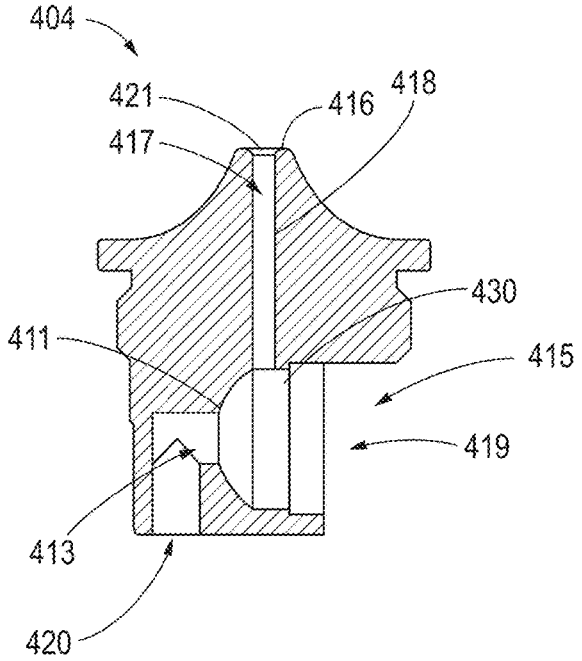
FIG. 4B is a cross-sectional view of an example dispensing plug body shown in FIG. 4A, according to certain embodiments of the present disclosure.

FIG. 4B is a cross-sectional view of the dispensing plug body 404 shown in FIG. 4A. With reference to FIGS. 4A-B collectively, the dispensing plug body 404 has a tip 416 similar to the tip 116 of FIG. 1. The dispensing plug body 404 may be made wholly or partially of silicone or another polymer and can include a fluid path 418 formed therein, where the fluid path 418 flows from an inlet 420 to an outlet 421 at the tip 416. The inlet 420 can correspond to an ingress point of fluids into the dispensing plug body 404 as generally described relative to the dispensing plug 104 of FIG. 1. The outlet 421 can correspond to an egress point of fluids out the tip 416.

Still with reference to FIG. 4B, the fluid path 418 can include an inlet section 413, a valve-insertion section 415, and an outlet section 417. The inlet section 413 and the outlet section 417 include the inlet 420 and the outlet 421, respectively. The valve-insertion section 415 includes an opening 419 and an inner section 430 having an inlet-side edge 411. In the illustrated embodiment, the valve-insertion section 415 has a wider profile than either the inlet section 413 or the outlet section 417. In various embodiments, the wider profile of the valve-insertion section 415 accommodates opening and closing functionality of an adjustable valve, as will be described in greater detail relative to FIG. 2B. Further, in the illustrated embodiment, the inner section 430 is contoured in conformance to a size and shape of an insertion end 427 of the valve portion 422. In the illustrated embodiment, the insertion end 427 is rounded in shape.

Figure 4C:
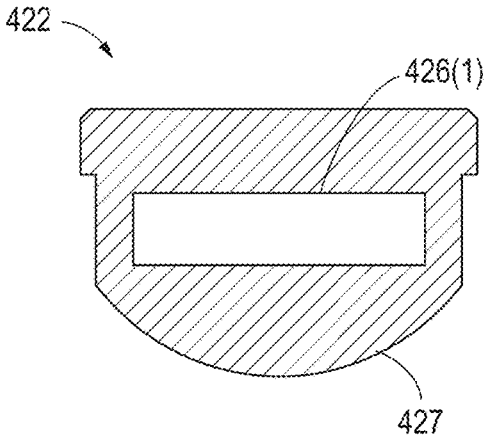
FIG. 4C is a cross-sectional view of an example valve portion shown in FIG. 4A, according to certain embodiments of the present disclosure.

FIG. 4C is a cross-sectional view of the valve portion 422 shown in FIG. 4A. The valve portion 422 includes a magnet 426(1) embedded therein. The valve portion 422 may be formed wholly or partially of silicone or another polymer. In some embodiments, the valve portion 422 may be considered a silicone-wrapped magnet, or as a magnet with a silicone or polymer wrapper, by virtue of the magnet 426(1) embedded therein. In the illustrated embodiment the valve portion 422 is sized and shaped to a contour of the valve-insertion section 415 of the dispensing plug body 404. More particularly, in the illustrated embodiment, the insertion end 427 of the valve portion 422 is sized and shaped to a rounded contour of the inner section 430 of the valve-insertion section 415.

Figure 4D:
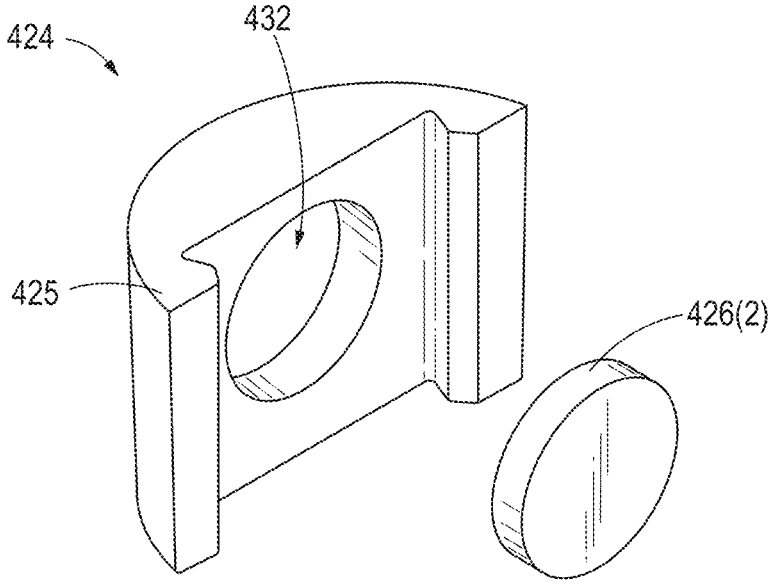
FIG. 4D is an exploded perspective view of another example valve portion shown in FIG. 4A, according to certain embodiments of the present disclosure.
Figure 4E:
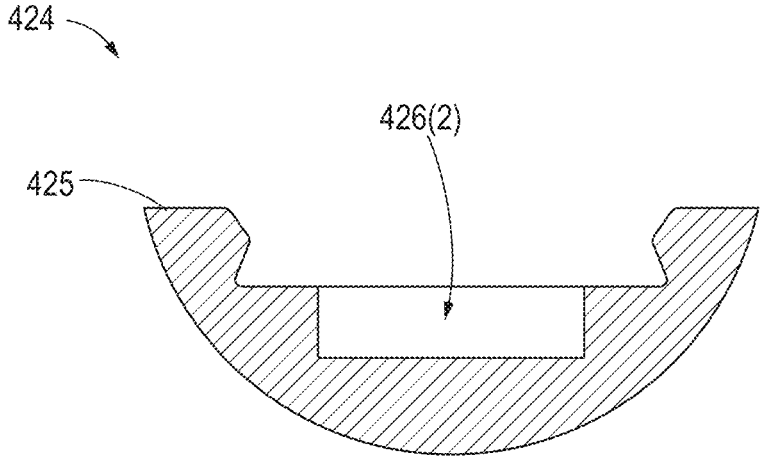
FIG. 4E is a top cross-sectional view of the valve portion shown in FIG. 4D, according to certain embodiments of the present disclosure.

FIGS. 4D and 4E illustrate the valve portion 424 shown in FIG. 4A. FIG. 4D is an exploded perspective view of the valve portion 424. FIG. 4E is a top cross-sectional view of the valve portion 424. Referring to FIGS. 4D-E collectively, the valve portion 424 includes a magnet 426(2) in a recess 432. A lip 425, which may also be considered an outer or exterior section of the valve portion 424, facilitates securement of the valve portion 424 to the dispensing plug body 404.

With reference to FIGS. 4A-E collectively, in the illustrated embodiment, the valve portion 422 of the adjustable valve 405 is positioned in the fluid path 418 between the inlet 420 and the outlet 421. The valve portion 424 of the adjustable valve 405 is inserted in the opening 419 such that the lip 425 thereof secures the valve portion 424 to the dispensing plug body 404. The valve portion 424 is oriented relative to the fluid path 418 to cause a biasing force to be exerted on the valve portion 422. In the example of FIGS. 4A-E, the biasing force is created by a magnetic force between the magnet 426(1) and the magnet 426(2). More particularly, the magnet 426(1) and the magnet 426(2) have like poles and are thus configured to repel each other, such that the biasing force is a repelling force between the two magnets. In various embodiments, the magnet 426(1) and 426(2) may be of the same or different size, shape, and/or strength.

Still with reference to FIGS. 4A-E and the adjustable valve 405, in certain embodiments, the biasing force, in the form of the repelling force between the magnet 426(1) and the magnet 426(2), biases the valve portion 422 toward closure of the fluid path 418. For example, the biasing force can cause the valve portion 422 to engage the inlet-side edge 411 of the valve-insertion section 415 and seal the fluid path 418 between the inlet 420 and the outlet 421. In certain embodiments, a narrower profile of the inlet section 413 halts further movement of the valve portion 422 in response to the biasing force, thus facilitating the seal. Specifically, the seal can block passage of fluids from the inlet section 413 to the outlet section 417.

Still with reference to FIGS. 4A-E and the adjustable valve 405, in certain embodiments, the biasing force causes the valve portion 422 to seal the fluid path 418 between the inlet 420 and the outlet 421 as described above unless, or until, the biasing force is overcome by an opposing force such as, for example, fluid pressure on an inlet side of the valve portion 422 (i.e., from the inlet section 413). The fluid pressure can be caused by compression force against the outer surface of a body of a flexible container, such as the body 110 of the flexible container 106 of FIG. 1. In various embodiments, when the opposing force overcomes the biasing force, the valve portion 422 moves toward the valve portion 424 (e.g., into a space therebetween as described relative to FIG. 2C) and at least partially opens the fluid path 418, thereby allowing fluids to flow from the inlet section 413 to the outlet section 417 and be dispensed out the tip 416 in proportion to an amount by which the opposing force exceeds the biasing force. In certain embodiments, when the opposing force no longer overcomes the biasing force, for example, as a result of a decrease in, or cessation of, the compression force, the biasing force, by virtue of its continuous or constant nature, immediately causes the valve portion 422 to again seal the fluid path 418 between the inlet 420 and the outlet 421 as described previously. In this way, the adjustable valve 405 can seal the fluid path 418 in the fashion described above whenever fluids are not being dispensed, thereby preventing microbial ingress, for example, from the outlet section 417 to the inlet section 413. Accordingly, in various embodiments, microbial ingress, for example, to a container such as the flexible container 106 of FIG. 1, can likewise be prevented.

Figure 5A:
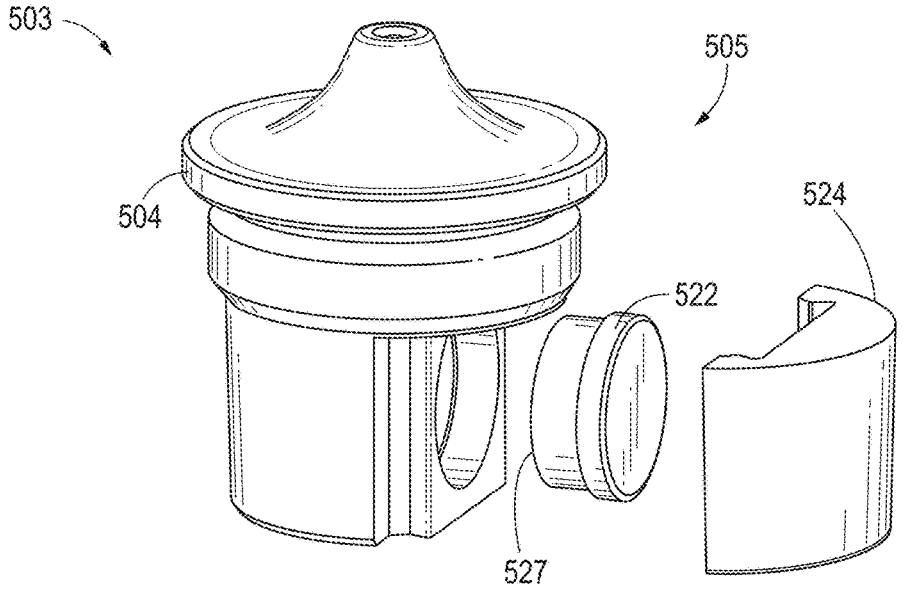
FIG. 5A is an exploded view of an example dispensing plug, according to certain embodiments of the present disclosure.
Figure 5B:
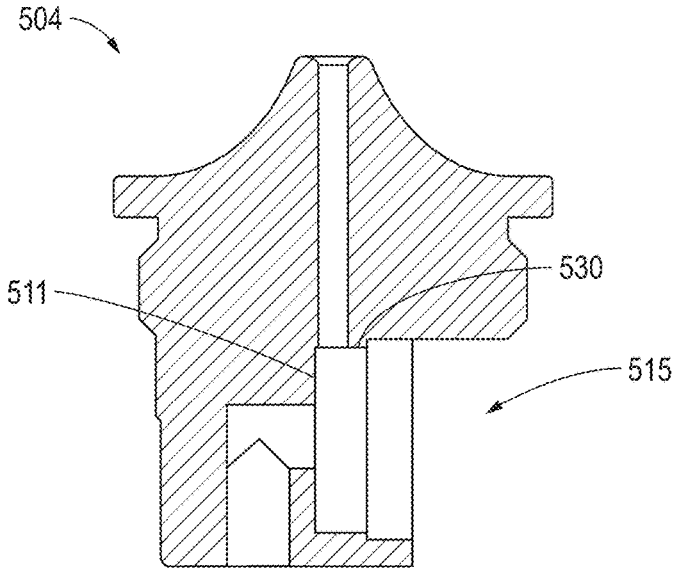
FIG. 5B is a cross-sectional view of an example dispensing plug body shown in FIG. 5A, according to certain embodiments of the present disclosure.
Figure 5C:
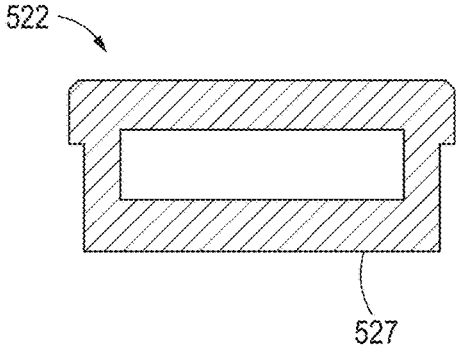
FIG. 5C is a cross-sectional view of an example valve portion shown in FIG. 5A, according to certain embodiments of the present disclosure.

FIGS. 5A-C illustrate an example of a dispensing plug 503. FIG. 5A is an exploded view of the dispensing plug 503. FIG. 5B is a cross-sectional view of a dispensing plug body 504. FIG. 5C is a cross-sectional view of a valve portion 522. Referring to FIGS. 5A-C collectively, the dispensing plug 503 includes the dispensing plug body 504 and an adjustable valve 505. In the illustrated embodiment, the adjustable valve 505 includes the valve portion 522 and a valve portion 524 that may correspond to the valve portion 424 of FIGS. 4A-E.

Referring to FIGS. 5A-C collectively, the dispensing plug 503 operates as generally described relative to the dispensing plug 403 of FIGS. 4A-E. In the illustrated embodiment, the valve portion 522 has an insertion end 527 that is flat in shape, as compared to the rounded shape of the insertion end 427 of the valve portion 422 shown in FIGS. 4A-E. In similar fashion, a valve-insertion section 515 of the dispensing plug body 504 is flat in accommodation of the size and flat shape of the insertion end 427. Other sizes and shapes for the insertion end 527 and the valve-insertion section 515 will be apparent to one skilled in the art after a detailed review of the present disclosure.

Figure 6:
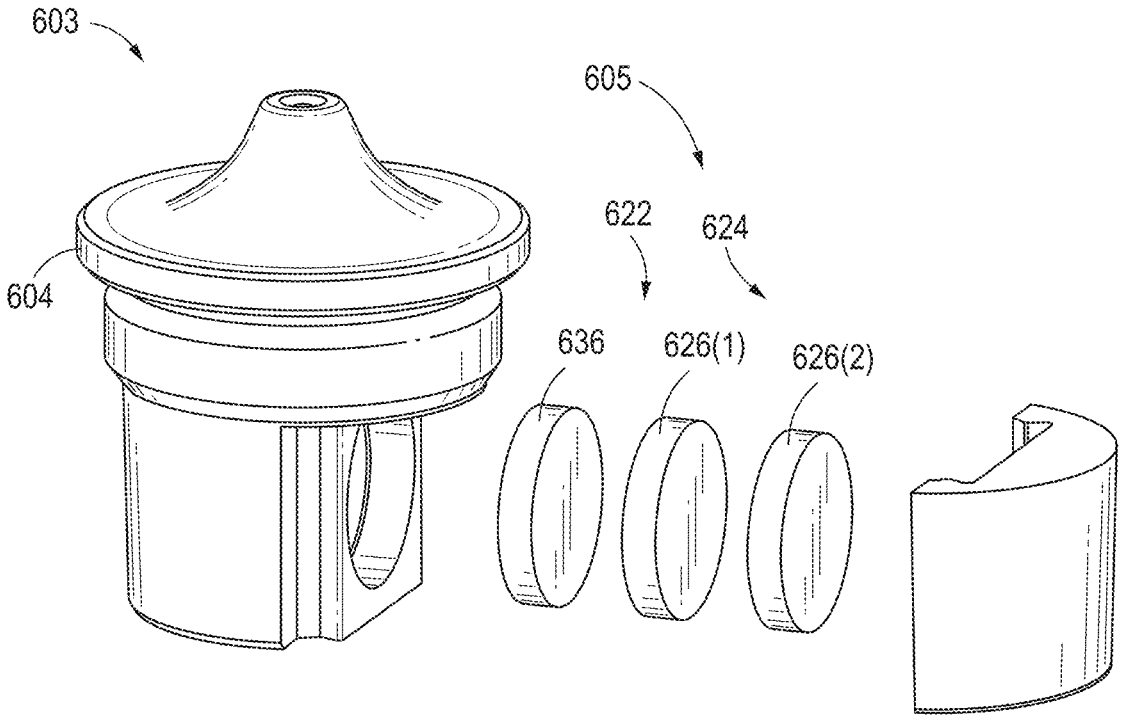
FIG. 6 is an exploded view of an example dispensing plug, according to certain embodiments of the present disclosure.

FIG. 6 illustrates an exploded view of an example of a dispensing plug 603. The dispensing plug 603 includes a dispensing plug body 604 and an adjustable valve 605. The dispensing plug body 604 may correspond, for example, to the dispensing plug body 504 of FIG. 5. In the illustrated embodiment, the adjustable valve 605 includes a valve portion 622 and a valve portion 624.

In the example of FIG. 6, the valve portion 622 includes separate pieces, in the form of a disc 636 and a magnet 626(1), that may be inserted into the dispensing plug body 604 as generally described relative to the valve portions 422 and 522 FIGS. 4A-E and 5A-C, respectively. The disc 636 can be formed of silicone or another polymer and, by virtue of its placement in the dispensing plug body 504, can shield or block the magnet 626(1) from fluid contact. The valve portion 624 includes a magnet 626(2) and may correspond to the valve portion 424 of FIGS. 4A-E or to the valve portion 524 of FIGS. 5A-C.

The foregoing description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with the language of the claims.

What is claimed is:

1. A dispensing plug comprising:
a fluid path comprising an inlet and an outlet; and
a valve adjustably disposed relative to the fluid path, the valve comprising:
a first valve portion positioned in the fluid path between the inlet and the outlet; and
a second valve portion oriented to cause a first force to be exerted on the first valve portion, the first force biasing the first valve portion toward closure of the fluid path, wherein a space separates the first valve portion and the second valve portion,
wherein the first valve portion comprises a first magnet and the second valve portion comprises a second magnet, the first force comprising a magnetic force between the first and second magnets; and
wherein the first valve portion at least partially opens the fluid path in response to fluid pressure on an inlet side thereof exerting a second force that overcomes the first force.

2. The dispensing plug of claim 1, wherein the first valve portion seals the fluid path between the inlet and the outlet at least until the second force overcomes the first force.

3. The dispensing plug of claim 1, wherein the first valve portion comprises a polymer wrapper around the first magnet.

4. The dispensing plug of claim 3, wherein the polymer wrapper is silicone.

5. The dispensing plug of claim 1, wherein the first valve portion comprises a silicone disc separate from the first magnet.

6. The dispensing plug of claim 1, wherein the first and second magnets are configured to repel each other, the first force comprising a repelling force between the first and second magnets.

7. The dispensing plug of claim 1, wherein the first and second magnets are configured to attract each other, the first force comprising an attracting force between the first and second magnets.

8. The dispensing plug of claim 1, wherein the second valve portion comprises a spring in contact with the first valve portion.

9. The dispensing plug of claim 1, wherein the first force is a continuing force exerted on the first valve portion.

10. A system for dispensing fluids, comprising:
a flexible container;
a dispensing plug placed within an opening of the flexible container, the dispensing plug comprising:
a fluid path comprising an inlet and an outlet; and
a valve adjustably disposed relative to the fluid path, the valve comprising:
a first valve portion positioned in the fluid path between the inlet and the outlet; and
a second valve portion oriented to cause a first force to be exerted on the first valve portion, the first force biasing the first valve portion toward closure of the fluid path, wherein a space separates the first valve portion and the second valve portion,
wherein the first valve portion comprises a first magnet and the second valve portion comprises a second magnet, the first force comprising a magnetic force between the first and second magnets; and
wherein the first valve portion at least partially opens the fluid path in response to fluid pressure on an inlet side thereof exerting a second force that overcomes the first force.

11. The system of claim 10, wherein the first valve portion seals the fluid path between the inlet and the outlet at least until the second force overcomes the first force.

12. The system of claim 10, wherein the first valve portion comprises a polymer wrapper around the first magnet.

13. The system of claim 12, wherein the polymer wrapper is silicone.

14. The system of claim 10, wherein the first and second magnets are configured to repel each other, the first force comprising a repelling force between the first and second magnets.

15. The system of claim 10, wherein the first and second magnets are configured to attract each other, the first force comprising an attracting force between the first and second magnets.

16. The system of claim 10, wherein the second valve portion comprises a spring in contact with the first valve portion.

17. The system of claim 10, wherein the first force is a continuing force exerted on the first valve portion.

* * * * *